United States Patent [19]

Templet

[11] Patent Number: 4,951,863

[45] Date of Patent: Aug. 28, 1990

[54] DOUBLE ENVELOPE CONSTRUCTION FOR FACSIMILE HANDLING AND METHOD

[75] Inventor: Vicki Templet, Wheaton, Ill.

[73] Assignee: Wallace Computer Services, Inc., Hillside, Ill.

[21] Appl. No.: 451,781

[22] Filed: Dec. 18, 1989

[51] Int. Cl.[5] ..... B65D 27/08

[52] U.S. Cl. ..... 229/72; 229/73; 229/75; 229/84; 383/40

[58] Field of Search ..... 229/72, 73, 75, 84; 383/40

[56] References Cited

U.S. PATENT DOCUMENTS

| | | | |
|---|---|---|---|
| 200,853 | 3/1878 | Benham | 229/72 |
| 225,540 | 3/1880 | Terry | 229/84 |
| 927,339 | 7/1909 | Earle | 229/72 |
| 1,166,772 | 1/1916 | Lockhart | 229/73 |
| 1,350,928 | 8/1920 | Homeniuk | 229/75 |
| 1,458,829 | 6/1923 | Kackley | 229/72 |
| 2,047,745 | 7/1936 | Poppe | 383/123 X |
| 2,517,843 | 8/1950 | Cochran | 229/73 |
| 2,917,164 | 12/1959 | Kehr | 383/40 X |
| 3,381,888 | 5/1968 | Schleutermann et al. | 229/72 |
| 3,719,319 | 3/1973 | Schleutermann et al. | 229/75 X |

FOREIGN PATENT DOCUMENTS

| | | | |
|---|---|---|---|
| 6270 | 10/1897 | Norway | 229/72 |

*Primary Examiner*—Stephen Marcus
*Assistant Examiner*—Jes F. Pascua
*Attorney, Agent, or Firm*—Tilton, Fallon, Lungmus & Chestnut

[57] ABSTRACT

Double envelope construction for facsimile handling and method including a unitary generally rectangular sheet folded on itself along two spaced apart transverse lines with complementary printed indica installed on the same face of the central and one end panel and which sandwich the other end panel which is imprinted but equipped with a closure flap.

7 Claims, 2 Drawing Sheets

DOUBLE ENVELOPE CONSTRUCTION FOR FACSIMILE HANDLING AND METHOD

BACKGROUND AND SUMMARY OF INVENTION

This invention relates to a double envelope construction for facsimile handling and method and, more particularly to a double envelope equipped with printed indicia, one face bearing "send" indicia and the other face "receive" indicia.

Double envelopes have been used in business for over a century —see, for example, U.S. Pat. No. 200,853 and, more recently, U.S. Pat. No. 3,856,198.

The double envelope is formed from a unitary, generally rectangular sheet having two transversely extending fold lines dividing the sheet into a first end panel, a central panel and a second end panel. The central and second end panels are folded over the front end panel to sandwich the same. The first end panel along one longitudinal side has an integral flap-providing extension. The envelope is closed along the other three sides.

This envelope facilitates two way inter-office communications. Papers sent to the facsimile machine (hereinafter "fax" machine) for transmission go into one side of the envelope bearing the "send" indicia and advantageously color coded —say in red.

After faxing, the operator can return the originals in the other side of the envelope which advantageously bears receive printed indicia which advantageously may be coded blue.

Incoming faxes can also be delivered in this envelope in the blue "delivery" or "receive" side.

Other objects and advantages of the invention may be seen in the details of construction and operation set down in the ensuing specification.

The invention is described in conjunction with an illustrative embodiment in the accompanying drawing, in which FIG. 1 is a perspective view of the inventive envelope viewed from one side;

DETAILED DESCRIPTION

Figure 1:
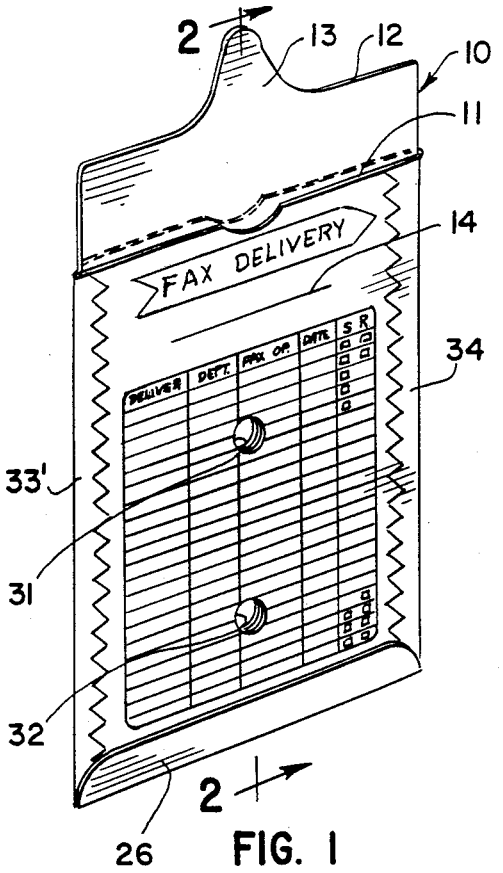
Figure 2:
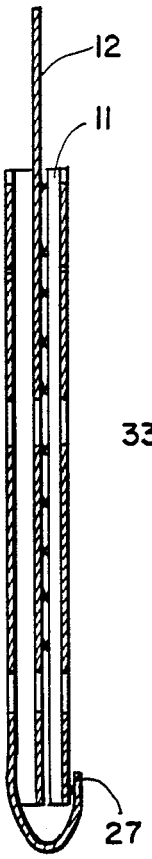
FIG. 2 is a cross sectional view taken along the sight line 2—2 of FIG. 1.

In the accompanying drawing and with reference to FIG. 1, the numeral 10 designates generally the inventive envelope which is seen to have a document receiving pocket at 11 and a closure flap 12. The closure flap 12, as can be appreciated from a consideration of FIG. 2 is advantageously equipped with an integral extension as at 13 which can be inserted into the slit 14.

Figure 3:
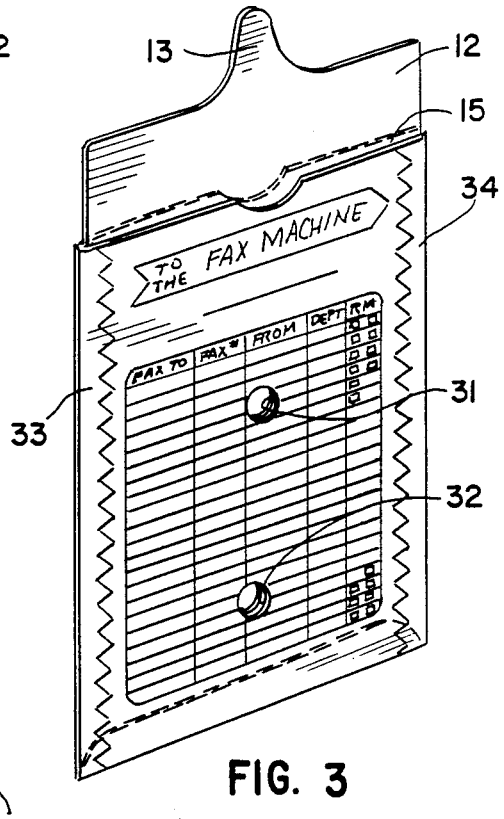
FIG. 3 is a second perspective view of the envelope but taken from the opposite side to that of FIG. 1.
Figure 4:
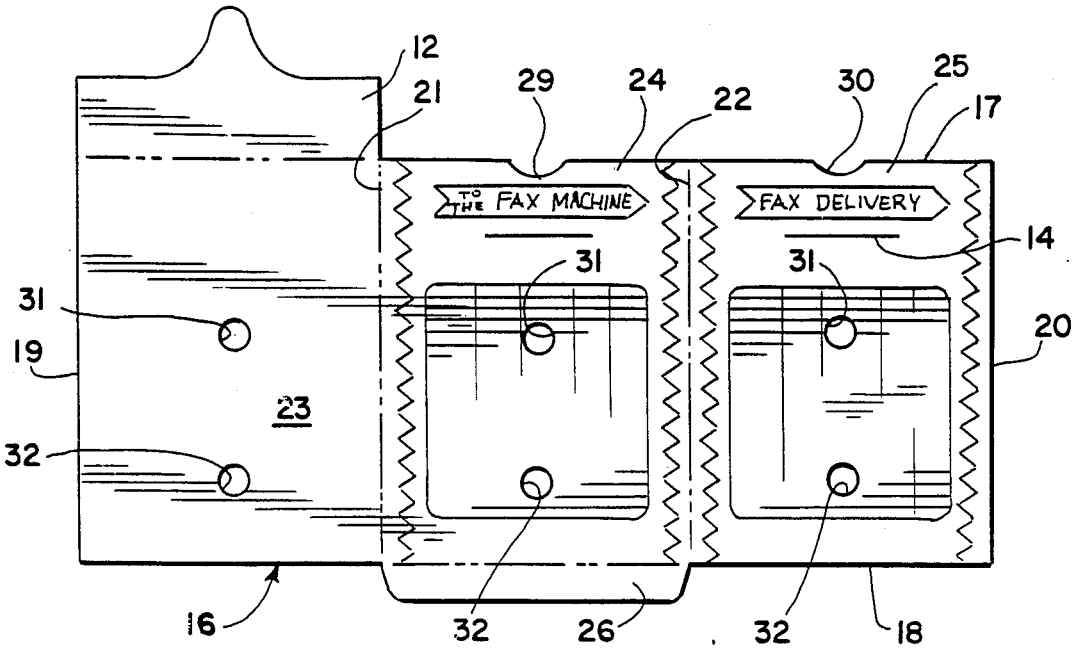
FIG. 4 is a plan view of a blank employed to develop the envelope of FIGS. 1–3.

In FIG. 3, the other document-receiving pocket 15 is seen and this advantageous construction can be advantageously developed from a blank generally designated 16 and illustrated in FIG. 4. The blank 16 is generally rectangular having a pair of longitudinally extending edges 17, 18 and a pair of transversely extending edges 19 and 20 and is printed on the surface facing out of the drawing.

The blank 16 is equipped with a pair of transversely extending lines of potential folding as at 21 and 22 which separate the blank into a first end panel 23, a central panel 24 and a second end panel 25. Extending integrally beyond the first longitudinal edge 17 from the first end panel 23 is the flap 12.

Another integral extension is provided at 26 (see the lower central portion of FIG. 4) wherein the central panel 24 is extended beyond the second longitudinal side 18. This extension is equipped with adhesive as can be appreciated from a consideration of FIG. 2 where the flap 26 has adhesive as at 27 and thus closes the bottom of the envelope.

Figure 5:
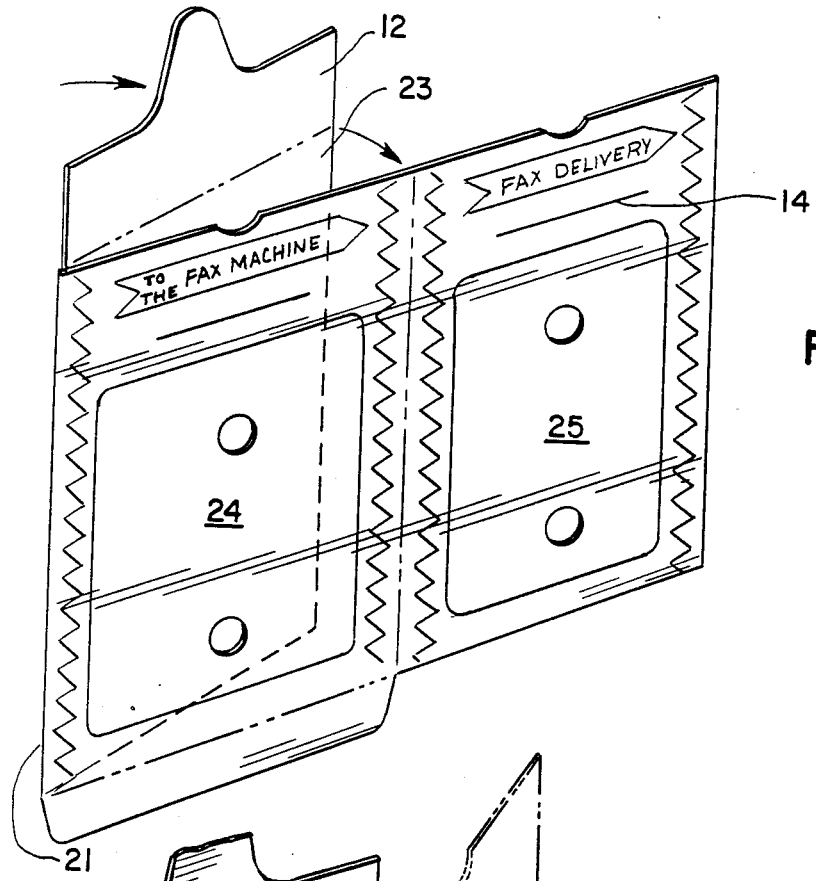
FIG. 5 is a perspective view illustrating the first step of forming the envelope with FIGS. 6–7 showing steps following.
Figure 6:
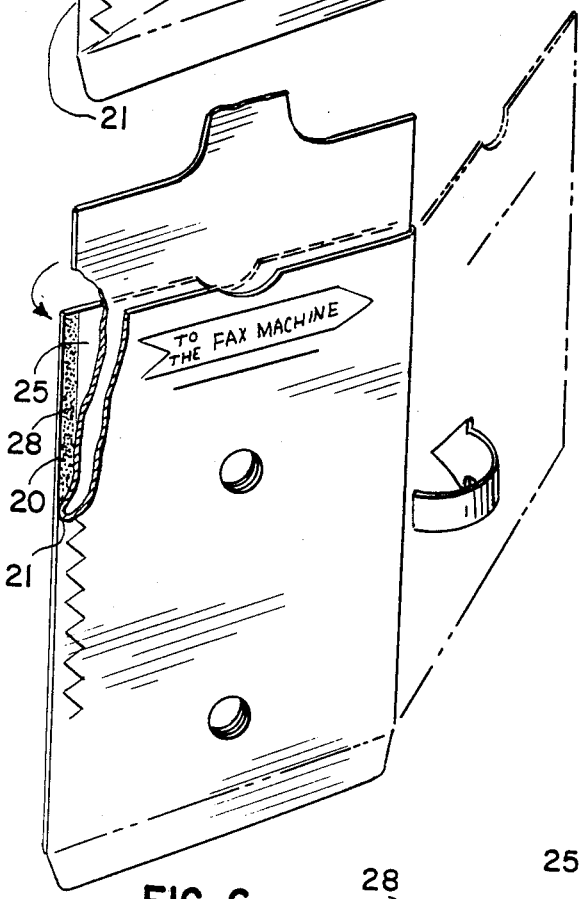
Figure 8:
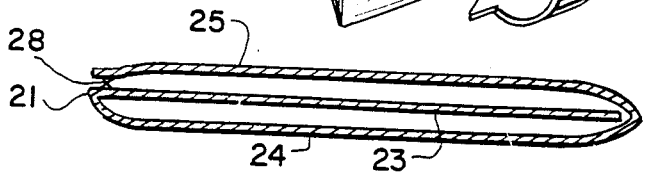
FIG. 8 is a sectional view taken along the sight line 8—8 applied to FIG. 7.

The sides of the envelope are closed first by the fold line 21 —see FIG. 5 —and second by adhesive 28 —see FIGS. 6 and 8 —joining the panel 25 adjacent the edge 20 to the panel 23 adjacent the fold line 21.

It is believed that the invention can be best understood by a consideration of the method of making which is set forth hereinafter.

Method of Making

Figure 7:
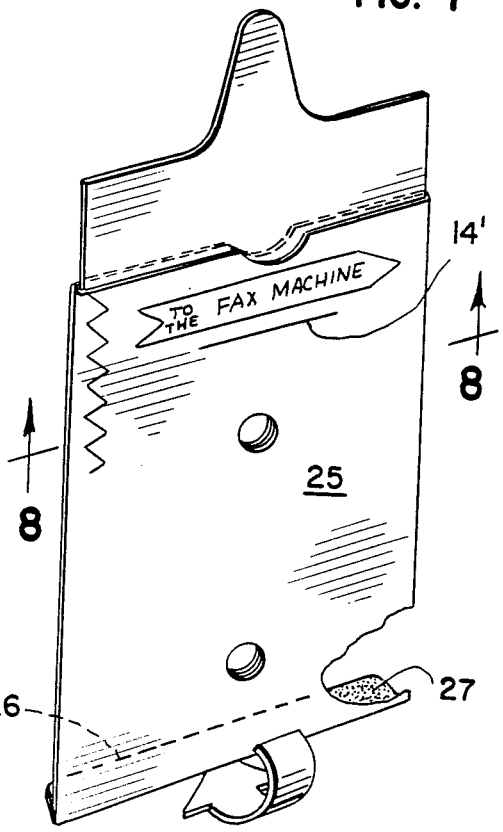

Prior to the development of the blank 16, a sheet having two surfaces is printed on one surface with certain facsimile information. For example, the uppermost surface seen in FIG. 4 has "fax delivery" printed on the second end panel 25 and in a fashion to be read when the flap 12 is positioned uppermost. This is advantageously in one color, blue, for example while the panel 24 is printed with fax "sending" indicia —in red, for example. Normally, the printing is performed on a two color press operating against a continuous web. The web is trimmed along the longitudinal edges to provide the flap 12, the bottom-forming extension 26 and notches 29, 30 in the panels 24, 25. Thereafter, the web is transversely scored along the lines 21, 22 and transversely severed to provide the transverse edges 19, 20, thereby developing the blank 16. Also, at this stage, the two viewing openings 31, 32 in each panel can be cut out. The blanks 16 are then delivered to a folder (not shown) which applies the adhesive ribbons 26, 27 to the unprinted face of the blank 16 and the three stages of folding performed as illustrated in FIGS. 5–7.

In use, the flap 12 can be folded into covering relation with either of the end panel 25 on the central panel 24 and the extension 13 can be inserted into either the slit 14 in panel 25 or the slit 14' in the central panel 24. Additionally, the provision of the flap 12 in its extended condition facilitates insertion of the normal $8\frac{1}{2}'' \times 11''$ material into the proper pocket of the double envelope. Also, the indicia may be varied widely as employing bold graphics on white Kraft stock to bring attention to urgent fax deliveries. Additionally, special information areas on each side can be tailored to the applications contemplated.

As a preferred embodiment of the invention, I provide a blank that is approximately 17" from the top of the flap extension 13 to the bottom of the panel 23 with the panels 23–25 having a transverse dimension of approximately 13". The transverse dimension of the extension 26 is approximately 1". Each of the panels 23–25 is approximately 10" in the longitudinal dimension.

Advantageously, the material of construction is 32 pound per ream white Kraft paper printed two colors to designate the different handling procedures.

OPERATION

In operation, the envelope 10 is normally provided in the condition seen in FIGS. 1 and 3. When a person desires to send a facsimile message he or she inserts the message— usually on 8½"×11" paper —into the pocket 15 as seen in FIG. 3. That there is material within the envelope can be immediately discerned from the viewing openings 31, 32. The sender then can fill in one of the column entitled "Fax To", "Fax No.", "From", "Dept." —or like identifying indicia. The last column entitled "R M" can be checked for either return of the material in the pocket 15 or mailing the same. As indicated previously, the color coding suggested is that the sending side of the envelope 10 is red and this can be highlighted by the serrated printed sections 33 and 34 which constitute red borders.

When a message is received, it can be conveniently placed in the pocket 11 —see FIG. 1 wherein the printing is in blue — including the serrated edges 33' and 34'. The facsimile machine attendant then fills in the columnar data including "Deliver", "Dept.", "Fax Op", "Date", and the like. The last column headed "S R" can designate whether the fax is sent or received. Again, the viewing openings 31, 32 are useful in determining whether material is present in the envelope 10.

While in the foregoing specification a detailed description of an embodiment of the invention has been set down for the purpose of illustration, many variations in the details hereingiven may be made by those skilled in the art without departing from the spirit and scope of the invention.

I claim:

1. A double envelope for facsimile messages comprising a unitary, generally rectangular sheet having two transversely-extending fold lines dividing said sheet into a first end panel, a central panel and a second end panel, said central panel overlying said first end panel and said second end panel underlying said first end panel, the transverse sides of said central and second end panels being secured together to provide outer faces on said central and second end panels, said first end panel along one longitudinal side having an integral flap extension adapted to overlie either said central or second end panels, central and first and second end panels being unsecured to said sheet along said one longitudinal side thereof and secured to said sheet along the other longitudinal side thereof, said central panel on said outer face thereof being equipped with one of facsimile send-/receive printed indicia, said second end panel on said outer face thereof being equipped with the complement of said one of said facsimile send/receive printed indicia, said indicia being printed so as to be readable when said first end panel extension is positioned uppermost.

2. The structure of claim 1 in which said printed indicia also include different colors for said send and receive indicia.

3. The structure of claim 1 in which the panel carrying the facsimile send printed indicia includes in columnar form spaces for identifying the intended facsimile recipient, the facsimile number, and the sender and whether the original is to be returned to the send or mailed to the intended recipient, the panel carrying the facsimile receive printed indicia including in columnar form spaces for identifying the intended facsimile recipient, the machine operator and date of transmission.

4. A blank for development into a double pocket envelope for facsimile handling comprising a unitary, generally rectangular sheet having longitudinal and transverse sides and equipped with a pair of spaced apart transverse lines of potential folding dividing said sheet into central and first and second end panels, said sheet adjacent one longitudinal side of said first end panels being equipped with an integral, flap-providing extension and adjacent the other longitudinal side of said central panel being equipped with an integral adhesive-equipped extension, said sheet having first and second faces, said second end panel on said first face being equipped with one of facsimile send/receive printed indicia said central panel on said first face being equipped with the complement of said one of facsimile send/receive printed indicia.

5. The blank of claim 4 in which the adhesive on said integral adhesive-equipped extension is on the second face thereof.

6. A method of making a double envelope for facsimile messages comprising providing a generally rectangular paper blank having longitudinal and transverse sides with an integral transversely extending flap-providing extension along one longitudinal side, folding said blank on itself along a first transverse line adjacent one longitudinal end of said extension to provide a first panel overlying a central panel, folding said blank on itself along a second transverse line adjacent the other longitudinal end of said central panel to provide a second end panel overlying said first end panel, adhesively securing the free transverse edges of said second end panel to said sheet, and adhesively securing the other longitudinal side of said panels together, said sheet having first and second faces, said central panel on the first face thereof being equipped with one of facsimile send/receive printed indicia and said second end panel face being equipped with the complement of said one of said facsimile send-/receive printed indicia.

7. The method of claim 6 in which the indicia is printed prior to folding said blank.

* * * * *